US005562159A

United States Patent [19]

Smith et al.

[11] Patent Number: 5,562,159

[45] Date of Patent: Oct. 8, 1996

[54] WELL UPLIFT SYSTEM

[75] Inventors: Robert M. Smith, Bechin; John E. Adams, Montrose, both of Scotland

[73] Assignee: Merpro Tortek Limited, Scotland

[21] Appl. No.: 295,698

[22] PCT Filed: Mar. 12, 1993

[86] PCT No.: PCT/GB93/00526

§ 371 Date: Jan. 9, 1995

§ 102(e) Date: Jan. 9, 1995

[87] PCT Pub. No.: WO93/18279

PCT Pub. Date: Sep. 16, 1993

[30] Foreign Application Priority Data

Mar. 13, 1992 [GB] United Kingdom ..... 9205475

[51] Int. Cl.[6] ..... E21B 43/00

[52] U.S. Cl. ..... 166/68

[58] Field of Search ..... 166/68, 105.4, 166/222, 223, 312, 369, 275, 310, 372, 375; 405/74; 417/55, 160

[56] References Cited

U.S. PATENT DOCUMENTS

| | | | |
|---|---|---|---|
| 1,484,601 | 2/1924 | Carmichael | 166/68 X |
| 1,758,376 | 5/1930 | Sawyer | 166/68 X |
| 2,349,062 | 5/1944 | Uren | 166/222 X |
| 2,593,497 | 4/1952 | Spearow | 166/68 X |
| 2,935,134 | 5/1960 | Tausch | 166/222 |
| 2,988,998 | 6/1961 | Wilkinson | 166/68 X |
| 3,822,750 | 7/1974 | Ping | 166/68 X |
| 3,873,238 | 3/1975 | Elfarr | 166/68 X |
| 4,059,156 | 11/1977 | Berg | 166/314 |
| 4,265,312 | 5/1981 | Thein | 166/68 X |
| 4,407,360 | 10/1983 | Hamrick | 166/105.4 X |
| 4,551,042 | 11/1985 | Hagedorn et al. | 406/93 |
| 4,603,735 | 8/1986 | Black | 166/68 |
| 4,952,099 | 8/1990 | Drobadenko et al. | 406/50 |
| 4,978,251 | 12/1990 | Drobadenko et al. | 406/50 |

FOREIGN PATENT DOCUMENTS

| | | |
|---|---|---|
| 2633263 | 12/1989 | France . |
| 92/08037 | 5/1992 | WIPO . |

*Primary Examiner*—Roger J. Schoeppel
*Attorney, Agent, or Firm*—Andrus, Sceales, Starke & Sawall

[57] ABSTRACT

A method of raising material, such as production fluid (6), from a bore hole (3) involves pumping water down a pipe (7) to a fluidising unit (A) so that the water activates and entrains the material and carries it up through a discharge conduit (8) to a separator (B).

5 Claims, 2 Drawing Sheets

WELL UPLIFT SYSTEM

Conventionally, production fluids, such as oil, are lifted out of a predrilled or naturally formed well hole in the ground, by the pressure under which an underground reservoir of the product is maintained, either naturally or artificially by injection in the neighbourhood of the reservoir of fluid such as water. Alternatively they are recovered by lowering a pump into the well hole at the lower end of a discharge conduit. If the product reservoir is not under a naturally occurring pressure, and the local pressure is raised by injection of, for example, water, the system is inefficient in that the applied pressure is dispersed throughout the ground and is not effective to direct the product up the well hole. Downhole pumps are also inefficient in that they necessarily transfer with the product spoil, in the form of particulate solids, which abrade, and at worst block, the pump. Production fluids are usually two phase, and include liquid and gas in varying proportions. Pumps have difficulty in handling such mixtures. Mechanical pumping also tends to shear liquid oil and to form, with the water present, an emulsion which takes a long time to separate again. Downhole pumps are also expensive and have high maintenance costs as a result of the inaccessibility of their moving parts.

In accordance with the present invention, a method of raising production fluid or material from a bore hole in the ground comprises pumping water down a first conduit in the bore hole into contact with the material whereby the material is entrained and carried up through a second conduit in the bore hole to a separator where at least partial separation of the water and material takes place.

By means of this method production fluids can readily be recovered from down a well, particularly as oil and gas will tend to rise in the water, quite apart from being entrained by it. Slugs of gas in the production fluid can be accommodated without difficulty. Emulsification of the oil with water is minimal so that preliminary separation of the oil, gas and water at the surface can be conducted comparatively simply with a short residence time in, for example, a settling tank or cyclone system. Although the method may not be quite as efficient in transferring the production fluids, as the downhole pump, the previously mentions problems of using pumps downhole are avoided and the trade off is considered to be beneficial.

The water may be taken at source, ie may be deaerated aquifier water thereby avoiding compatibility problems. It is believed that, in a typical case, adequate water could be pumped down the borehole by means of a centrifugal pump providing a pressure of the order of 2500 psig.

Complete separation of the water from the oil and gas is unnecessary as the water which has been at least partially separated may be arranged to pass around a closed loop and pumped down the first conduit again. This also minimises compatibility problems.

Although the method is seen as being of particular value in recovering production fluids from an oil-well, it is believed to have other applications, for example in recovering material such as drill cuttings from the bottom of a drill pipe which is used to cut the bore hole. The material is preferably entrained by the use of a fluidising unit located downhole, and to and from which the first and second conduits respectively lead, the fluidising unit being of a kind having a supply duct which is connected to the first conduit and a discharge duct which is connected to the second conduit and which is located within the supply duct, the end of the discharge duct extending beyond the end of the supply duct. Such a unit operates in that water injected out through the supply duct activates the material which is consequently driven centrally up through the discharge duct, entrained in the fluid, and hence to the surface. The fluidising effect is enhanced if the water is arranged to swirl as it leaves the supply duct, for example as a result of the first conduit leading tangentially into the supply duct, or by means of helical vanes within the supply duct. A fluidising unit which operates on this principal is disclosed in our U.S. Pat. No. 4978251.

The invention also includes a system for raising material from a bore hole in the ground, the system comprising a fluidising unit which is arranged to be located downhole and which includes a supply duct having an outlet at its end and being connected to a first conduit which extends from a pump down through the bore hole to supply fluid under pressure to the supply duct, and, within the supply duct, a discharge duct, which has at its end an inlet located beyond the fluid supply duct outlet, the discharge duct being connected to a second conduit which extends up through the bore hole to a separator for at least partially separating the fluid and the material.

An example of an oil-well and associated plant, constructed in accordance with the present invention, is illustrated diagrammatically in the accompanying drawings, in which.

Figure 1:
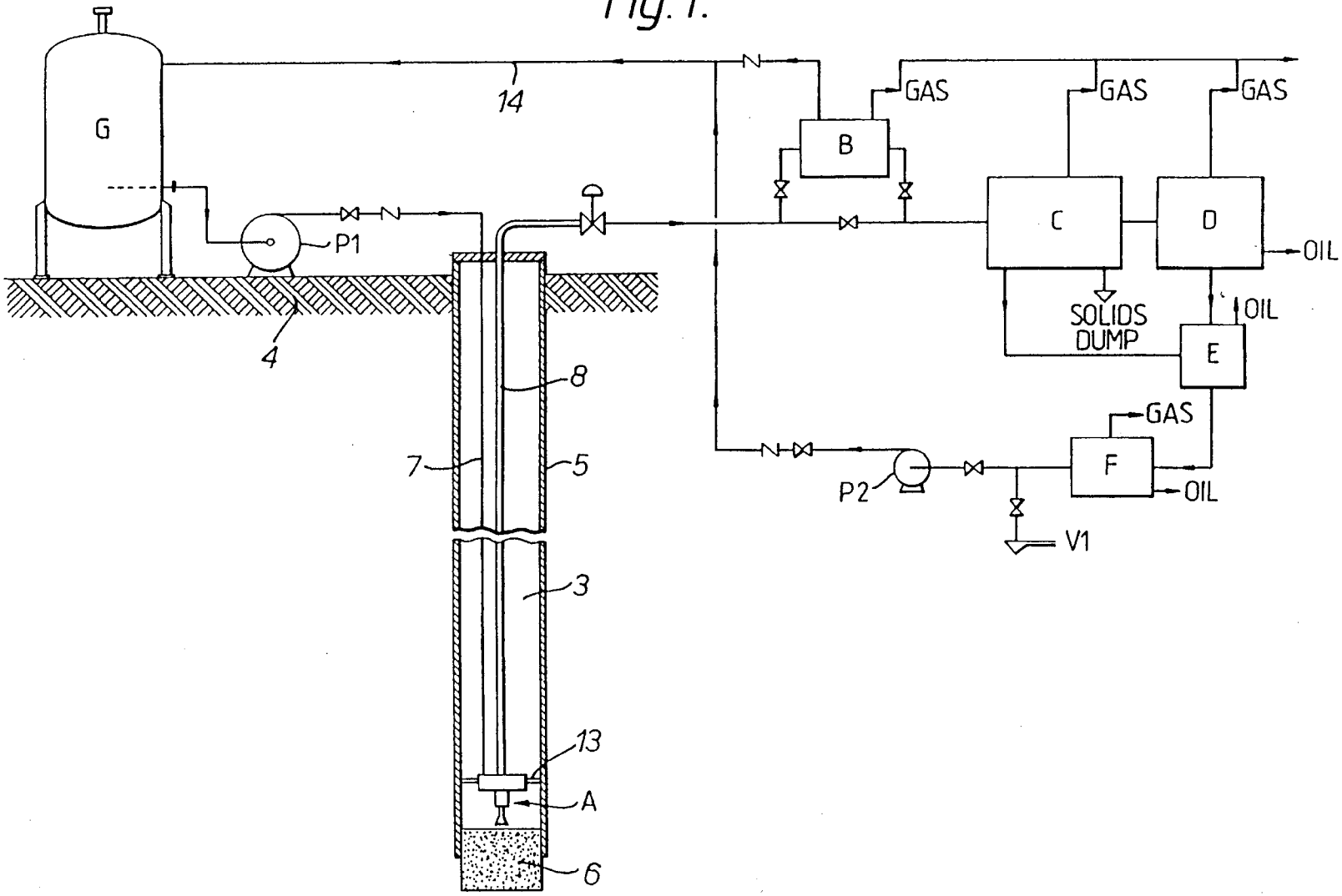
FIG. 1 is a diagram showing the essential parts.
Figure 2:
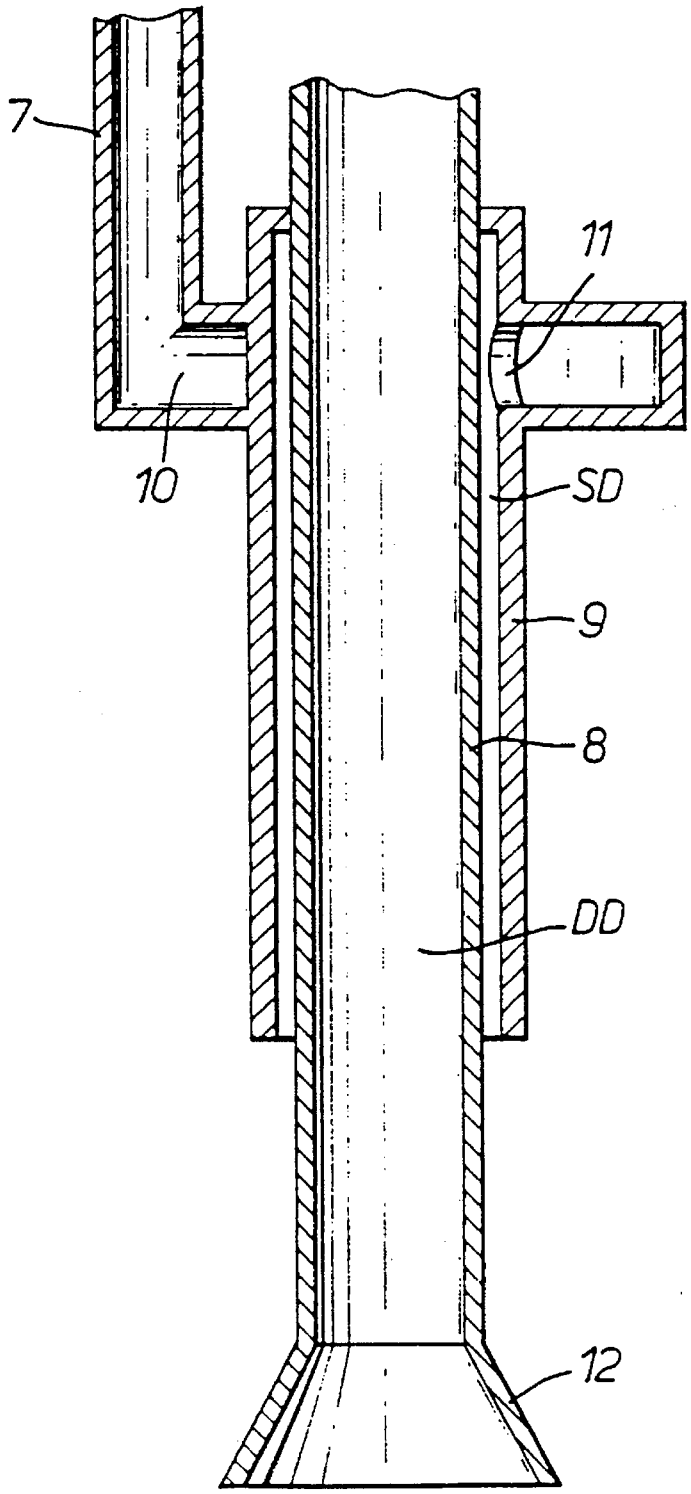
FIG. 2 is a longitudinal section through a fluidising unit.

As shown in FIG. 1, a well 3 has been bored down into the ground 4, and may have a casing 5. Production fluid 6 collects in the bottom of the well. Extending down the well, within an appropriate tool string, are a supply pipe 7 and a discharge pipe 8, both of which are connected at the bottom to a fluidising unit A. This is shown in section in FIG. 2. The unit has a cylindrical housing 9 through which there extends the lower end of the pipe 8. The pipe 7 leads into a manifold 10 which surrounds the top of the housing 9 and has a tangential inlet 11 into the annular space between the pipe 8 and housing 9, that space forming a supply duct SD. The lower end of the pipe 8 forms a discharge duct DD and terminates in a flared portion 12. The annular space between the pipe 8 and housing 9 may be provided with vanes in addition, or instead of the inlet 11 being tangential, in order to cause water discharged down through the supply duct to swirl.

In use, with a packer 13 isolating the space below the unit A, deaerated water is pumped by a pump P1 at the mudline, rig or surface, from a storage container G down the pipe 7 and through the supply duct SD to activate and entrain the production fluid 6, which is then carried up the discharge duct DD and pipe 8 to a settling chamber B. In this oil, gas and water, and any solids present, will separate into respective layers. A device C separates bulk water from the phases from the well with the bulk water phase being diverted to a device E- in which small quantities of oil are removed from the water so that it can be degassed and deoiled further in a device F prior to being either dumped to waste via a valve V1 or recycled via a pump P2 to the storage vessel G via a line 14. The device C also allows the gas to be separated from the fluids, and for solids to settle out, the oil phase passing to a second stage D which further treats the fluids if required to achieve export quality crude oil. Chemicals can be injected into any of the devices to enhance the efficiency of the system.

We claim:

1. A method for raising oil from an underground petroleum reservoir containing the oil and associated hydrocarbon gas through a well to the surface of the ground, said method employing water as an aqueous lifting medium, said method minimizing emulsification of the oil and water during raising and accommodating slugs of gas accompanying the oil being raised, said method comprising the steps of:

passing the water from the surface of the ground down a first conduit (7) in the well to a supply duct (SD) of a fluidizing unit (A), said fluidizing unit being located downhole in the well and proximate to the oil to be raised, the supply duct of the fluidizing unit peripherally surrounding a central discharge duct (DD) of the fluidizing unit;

supplying water out of the fluidizing unit at an outlet end of the peripheral supply duct and introducing the water into the oil exteriorly of the fluidizing unit to entrain the oil in the water;

returning the water and the oil entrained therein to an inlet end of the central discharge duct of the fluidizing unit, the peripheral supply of the water and central return of the water and entrained oil forming a fluid flow pattern exteriorly of the fluidizing unit that obtains entrainment of the oil in the water while minimizing emulsification of the oil and the water;

raising the water, entrained oil, and any accompanying gas, up the well in a second conduit (8) which is coupled to the discharge duct of the fluidizing unit for discharge from the well at the surface of the ground; and separating the entrained oil and the water.

2. A method according to claim 1, wherein the step of returning the water and entrained oil is further defined as returning the water and entrained oil to an inlet end of the discharge duct that extends beyond the outlet end of the supply duct.

3. A method according to claim 1, in which water which has been at least partially separated from the entrained oil is recirculated down the first conduit.

4. A method according to claim 1, wherein the step of supplying water from the outlet end of the supply duct is further defined as providing a swirl to the water as it leaves the outlet end of the supply duct.

5. A method according to claim 2, wherein the step of supplying water from the outlet end of the supply duct is further defined as providing a swirl to the water as it leaves the outlet end of the supply duct.

* * * * *